US010290270B2

(12) United States Patent
Jeong et al.

(10) Patent No.: US 10,290,270 B2
(45) Date of Patent: May 14, 2019

(54) DISPLAY APPARATUS

(71) Applicant: Samsung Display Co., Ltd., Yongin-si, Gyeonggi-do (KR)

(72) Inventors: Yong-ju Jeong, Seoul (KR); Jae-kook Kim, Asan-si (KR); Seung-woon Shin, Asan-si (KR); Choongseob Oh, Yongin-si (KR); Hyoungbin Lim, Asan-si (KR); Minsung Choi, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 305 days.

(21) Appl. No.: 15/069,766

(22) Filed: Mar. 14, 2016

(65) Prior Publication Data

US 2017/0018235 A1 Jan. 19, 2017

(30) Foreign Application Priority Data

Jul. 16, 2015 (KR) ..... 10-2015-0101097

(51) Int. Cl.
*G09G 3/36* (2006.01)
*G09G 3/34* (2006.01)
*G09G 5/06* (2006.01)

(52) U.S. Cl.
CPC ..... *G09G 3/3607* (2013.01); *G09G 3/3413* (2013.01); *G09G 3/3648* (2013.01);
(Continued)

(58) Field of Classification Search
CPC combination set(s) only.
See application file for complete search history.

(56) References Cited

U.S. PATENT DOCUMENTS 7,053,880 B2 5/2006 Lim et al.
2003/0179170 A1* 9/2003 Lee ..... G09G 3/3648 345/87

(Continued)

FOREIGN PATENT DOCUMENTS

KR 10-2005-0095443 A 9/2005
KR 10-2008-0042433 A 5/2008

(Continued)

OTHER PUBLICATIONS

Abstract for KR 10-2003-0076756 A, dated Sep. 29, 2003, which corresponds to KR 10-0853210 B1 Listed Above, 1 page.

(Continued)

*Primary Examiner* — Robin J Mishler
(74) *Attorney, Agent, or Firm* — Lewis Roca Rothgerber Christie LLP

(57) ABSTRACT

There is provided a display apparatus comprising: a backlight configured to output a first and a second light having a first and second color during a first and second field of a frame; a mapper configured to map an input image signal into a first and a second mapping data corresponding to the first and second light; a compensator configured to compensate a first and a second color mapping data on a basis of a first and a second DCC compensation data so as to generate a first and second color output image data; and a liquid crystal panel comprising a transmissive sub pixel configured to modulate the first and second light on a basis of the first and second color output data to display a first image having the first color and a second image having the second color.

16 Claims, 9 Drawing Sheets

(52) U.S. Cl.
CPC ..... *G09G 5/06* (2013.01); *G09G 2300/0452* (2013.01); *G09G 2300/0456* (2013.01); *G09G 2310/0235* (2013.01); *G09G 2320/0242* (2013.01); *G09G 2320/0252* (2013.01); *G09G 2320/041* (2013.01); *G09G 2320/0673* (2013.01); *G09G 2340/06* (2013.01); *G09G 2340/16* (2013.01)

(56) References Cited

U.S. PATENT DOCUMENTS

| | | | | |
|---|---|---|---|---|
| 2009/0015541 | A1* | 1/2009 | Honbo | G09G 3/342 345/102 |
| 2009/0309903 | A1* | 12/2009 | Park | G09G 3/3611 345/690 |
| 2011/0057959 | A1* | 3/2011 | Park | G09G 3/3648 345/690 |
| 2013/0300771 | A1* | 11/2013 | Cho | G09G 5/026 345/690 |
| 2016/0086550 | A1 | 3/2016 | Shin et al. | |

FOREIGN PATENT DOCUMENTS

| | | | |
|---|---|---|---|
| KR | 10-0853210 | B1 | 8/2008 |
| KR | 10-0910557 | B1 | 8/2009 |
| KR | 10-2012-0127190 | A | 11/2012 |
| KR | 10-1252089 | B1 | 4/2013 |
| KR | 10-1303538 | B1 | 9/2013 |
| KR | 10-2014-0111876 | A | 9/2014 |
| KR | 10-2015-0021621 | A | 3/2015 |
| KR | 10-2015-0081173 | A | 7/2015 |
| KR | 10-2016-0033831 | | 3/2016 |

OTHER PUBLICATIONS

Abstract for KR 10-2004-0041939 A, dated May 20, 2004, which corresponds to KR 10-0910557 B1 Listed Above, 1 page.
Abstract for KR 10-2008-0002301 A, dated Jan. 4, 2008, which corresponds to KR 10-1252089 B1 Listed Above, 1 page.
Abstract for KR 10-2009-0126982 A, dated Dec. 9, 2009, which corresponds to KR 10-1303538 B1 Listed Above, 1 page.

* cited by examiner

DISPLAY APPARATUS

CROSS-REFERENCE TO RELATED APPLICATION

This U.S. non-provisional patent application claims priority to, and the benefit of, Korean Patent Application No. 10-2015-0101097, filed on Jul. 16, 2015, the entire content of which is hereby incorporated by reference.

BACKGROUND

1. Field

The present disclosure herein relates to a display apparatus.

2. Description of the Art

Liquid crystal display apparatuses are a kind of flat panel display apparatuses and being used for displaying an image on various devices such as televisions, monitors, notebooks, and/or mobile phones.

Such a liquid crystal display apparatus adjusts the intensity of an electric field that is applied to a liquid crystal material disposed between two substrates and the intensity of light passing through the two substrates to display an image. The liquid crystal display apparatus includes a liquid crystal panel for displaying an image and a backlight unit (e.g., backlight) for supplying light to the liquid crystal display panel.

The backlight unit may be classified into an edge type backlight unit (e.g., edge backlight) and a direct type backlight unit (e.g., direct backlight) according to a position of a light source for generating light. The edge type backlight unit includes a light guide plate and a light source for providing light to a side surface of the light guide plate. The direct type backlight unit includes a diffusion plate and a light source for providing light to a bottom (rear) surface of the diffusion plate.

Also, there is a time division type (kind) or field sequential type (kind) liquid crystal display apparatus that has high transmittance and is capable of realizing a full color display with an inexpensive manufacturing cost when compared to a space division type liquid crystal display apparatus. In the time division type liquid crystal apparatus, independent red, green, and blue light sources are sequentially and periodically turned on, and a control signal corresponding to each pixel is applied in synchronization with the lighting period of the light sources to obtain a full color image. In this case, one pixel is not spatially divided into red, green, and blue pixels, but is time-divided to sequentially display images. Thus, an image may be displayed by using an eye's after-image effect.

SUMMARY

Aspects of embodiments of the present disclosure are directed toward a liquid crystal display apparatus having improved color reproducibility.

According to some embodiments of the inventive concept, there is provided a display apparatus comprising: a backlight configured to output a first light having a first color during a first field of a frame and to output a second light having a second color during a second field of the frame; a mapper configured to map an input image signal into a first mapping data corresponding to the first light and a second mapping data corresponding to the second light; a compensator configured to compensate a first color mapping data of the first mapping data on a basis of a first DCC compensation data so as to generate a first color output image data, and to compensate a second color mapping data of the second mapping data on a basis of second DCC compensation data so as to generate a second color output image data; and a liquid crystal panel comprising a transmissive sub pixel configured to modulate the first light on a basis of the first color output data during the first field to display a first image having the first color, and to modulate the second light on a basis of the second color output data during the second field to display a second image having the second color.

In an embodiment, the first DCC compensation data is determined based on first leakage light of the first light, the first leakage light being light leaking from the transmissive sub pixel, and the second DCC compensation data is determined based on second leakage light of the second light, the second leakage light being light leaking from the transmissive sub pixel.

In an embodiment, the first DCC compensation data is determined based on a first luminance coefficient of the first color, and the second DCC compensation data is determined based on a second luminance coefficient of the second color.

In an embodiment, the first luminance coefficient is greater than the second luminance coefficient, and the first DCC compensation data has a value less than that of the second DCC compensation data.

In an embodiment, the compensator comprises a first DCC compensator and a second DCC compensator, the first DCC compensator comprises: a first lookup table configured to store the first DCC compensation data; and a first sub DCC compensator configured to receive the first color mapping data and to compensate the first color mapping data with reference to the first DCC compensation data, from the first lookup table, to generate the first color output image data, and the second DCC compensator comprises: a second lookup table configured to store the second DCC compensation data; and a second sub DCC compensator configured to receive the second color mapping data and to compensate the second color mapping data with reference to the second DCC compensation data, from the second lookup table, to generate the second color output image data.

In an embodiment, the liquid crystal panel comprises a first color sub pixel comprising a first color filter and a second color sub pixel comprising a second color filter, and the first color filter is configured to transmit a third color therethrough, the second color filter is configured to transmit a fourth color filter therethrough, and the first color is a mixed color of the third and fourth colors.

In an embodiment, the first color is a yellow color, and the second color is a blue color.

In an embodiment, the compensator is further configured to compensate third and fourth color mapping data of the first mapping data on a basis of third DCC compensation data to generate third and fourth color output image data.

In an embodiment, the first color sub pixel is configured to modulate the first light on a basis of the third color output image data during the first field to display a third image having the third color, and the second color sub pixel is configured to modulate the first light on a basis of the fourth color output image data during the first field to display a fourth image having the fourth color.

In an embodiment, the mapper further comprises an ACC compensator configured to ACC compensate the first and second color mapping data.

In an embodiment, the ACC compensator comprises: a first sub ACC compensator configured to ACC compensate the first color mapping data; and a second sub ACC compensator configured to ACC compensate the second color mapping data.

In an embodiment, each of the first and second DCC compensation data comprises a plurality of temperature DCC compensation data determined according to a driving temperature, and the compensator is further configured to select a temperature DCC compensation data corresponding to present driving temperature from among the plurality of temperature DCC compensation data.

In an embodiment, the first DCC compensation data comprises a plurality of first light intensity DCC compensation data determined according to an intensity of the first light, and the compensator is further configured to generate the first output image data on a basis of a first light intensity DCC compensation data corresponding to a present intensity of the first light from among the plurality of first light intensity DCC compensation data.

In an embodiment, the second DCC compensation data comprises a second light intensity DCC compensation data determined according to an intensity of the second light, and the compensator is further configured to generate the second output image data on a basis of a second light intensity DCC compensation data corresponding to the present intensity of the second light from among the plurality of second light intensity DCC compensation data.

In an embodiment, the transmissive sub pixel does not comprise a color filter.

BRIEF DESCRIPTION OF THE DRAWINGS

The accompanying drawings are included to provide a further understanding of the present inventive concept, and are incorporated in and constitute a part of this specification. The drawings illustrate exemplary embodiments of the present inventive concept and, together with the description, serve to explain principles of the present inventive concept. In the drawings.

DETAILED DESCRIPTION

Figure 1:
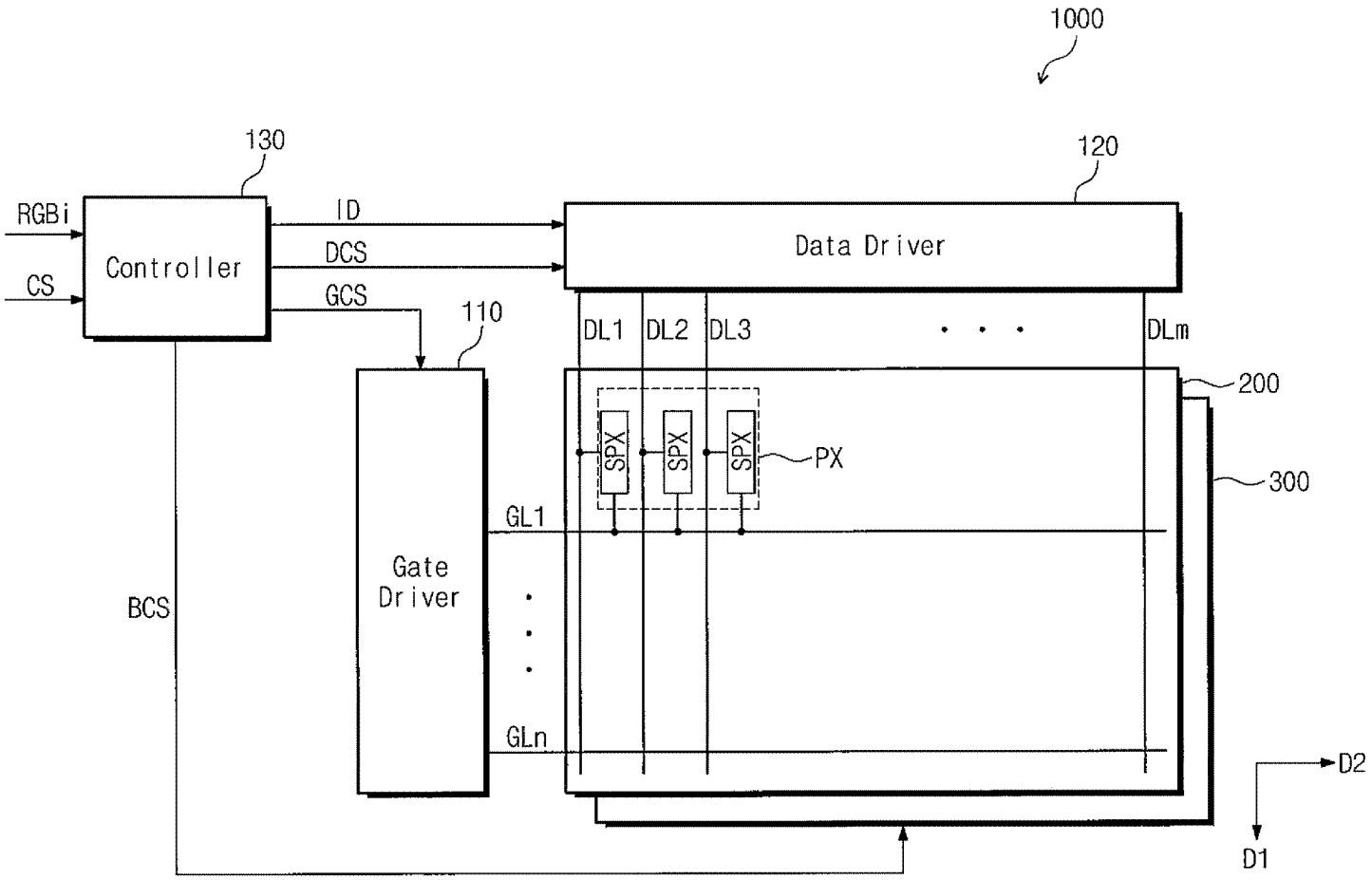
FIG. 1 is a schematic perspective view of a display apparatus according to an embodiment of the present inventive concept.

Since the present disclosure may have diverse modified embodiments, exemplary embodiments are illustrated in the drawings and are described in the detailed description of the present inventive concept. However, this does not limit the present disclosure within specific embodiments and it should be understood that the present disclosure covers all the modifications, equivalents, and replacements within the idea and technical scope of the present inventive concept.

Like reference numerals refer to like elements throughout in the drawings, the dimensions and size of each structure are exaggerated, omitted, or schematically illustrated for convenience in description and clarity. Exemplary embodiments of the present inventive concept will be described below in more detail with reference to the accompanying drawings.

FIG. 1 is a schematic perspective view of a display apparatus according to an embodiment of the present inventive concept.

Referring to FIG. 1, a display apparatus 1000 according to an embodiment of the present inventive concept includes a display panel 200 for displaying an image, gate and data drivers 110 and 120 for driving the display panel 200, and a controller 130 for controlling operations of the gate and data drivers 110 and 120.

The controller 130 receives an input image signal RGBi and a plurality of control signals CS from the outside of the display apparatus 1000. The controller 130 converts data format of the input image signal RGBi to match an interface specification of the data driver 120 and a structure of the display panel 200, to generate output image data ID and then to provide the output image data ID to the data driver 120.

Also, the controller 130 generates a data control signal DSC (e.g., an output start signal, a horizontal start signal, and the like) and a gate control signal GCS (e.g., a vertical start signal, a vertical clock signal, and a vertical clock bar signal) on the basis of the plurality of control signals CS. The data control signal DCS is provided to the data driver 120, and the gate control signal GCS is provided to the gate driver 110.

The gate driver 110 sequentially outputs gate signals in response to the gate control signal GCS provided from the controller 130.

The data driver 120 converts the output image data 1D into data voltages in response to the data control signal DCS provided from the controller 130 to output the converted data voltages. The outputted data voltages are applied to the display panel 200.

The display panel 200 includes a plurality of gate lines GL1 to GLn, a plurality of data lines DL1 to DLm, and a plurality of sub pixels SPX. For convenience of illustration, only the first and n-th gate lines GL1 and GLn of the plurality of gate lines GL1 to GLn, and only the first, second, third, and m-th data lines DL1, DL2, DL3, and DLm of the plurality of data lines DL1 to DLm are illustrated in FIG. 1.

The plurality of gate lines GL1 to GLn extend in a second direction D2 and are arranged in a first direction D1 perpendicular to (crossing) the second direction D2. The plurality of gate lines GL1 to GLn is connected to the gate driver 110 to receive the gate signals from the gate driver 110.

The plurality of data lines DL1 to DLm extend in the first direction D1 and are arranged in the second direction D2. The plurality of data lines DL1 to DLm is connected to the data driver 120 to receive data signals from the data driver 120.

The sub pixels SPX are arranged in a matrix form along the first and second directions D1 and D2. The sub pixels SPX may display at least one of primary colors, such as red, green, and blue colors. However, the colors that are capable of being displayed by the sub pixels SPX are not limited to the red, green, and blue colors. For example, the sub pixels SPX may display various colors including secondary primary colors, such as white, yellow, cyan, and magenta colors, in addition to the red, green, and blue colors.

The sub pixels SPX may be grouped to form a pixel PX. For example, three sub pixels SPX are grouped to form one pixel PX. However, embodiments of the present inventive concept are not limited thereto. For example, two, four, or more sub pixels may be grouped to form one pixel PX.

The pixel PX may be defined as a constituent for displaying a unit image. A resolution of the display panel 200 may be determined according to the number of pixels PX provided on the display panel 100. For convenience of illustration, only pixel PX is illustrated in FIG. 1. The pixel PX and the rest of pixels may be arranged in a matrix form along the first direction D1 and the second direction D2 perpendicular to (crossing) the first direction D1.

The sub pixels SPX may be connected to corresponding gate lines of the plurality of gate lines GL1 to GLn and corresponding data lines of the plurality of data lines DL1 to DLm to operate.

The display apparatus 1000 may further include a backlight unit (e.g., a backlight) 300. The backlight unit 300 receives a backlight control signal BCS that is generated by the controller 130. The backlight unit 300 generates light in response to the backlight control signal BCS to supply light to the display panel 200.

Hereinafter, a structure and operation of one sub pixel SPX will be further described.

Figure 2:
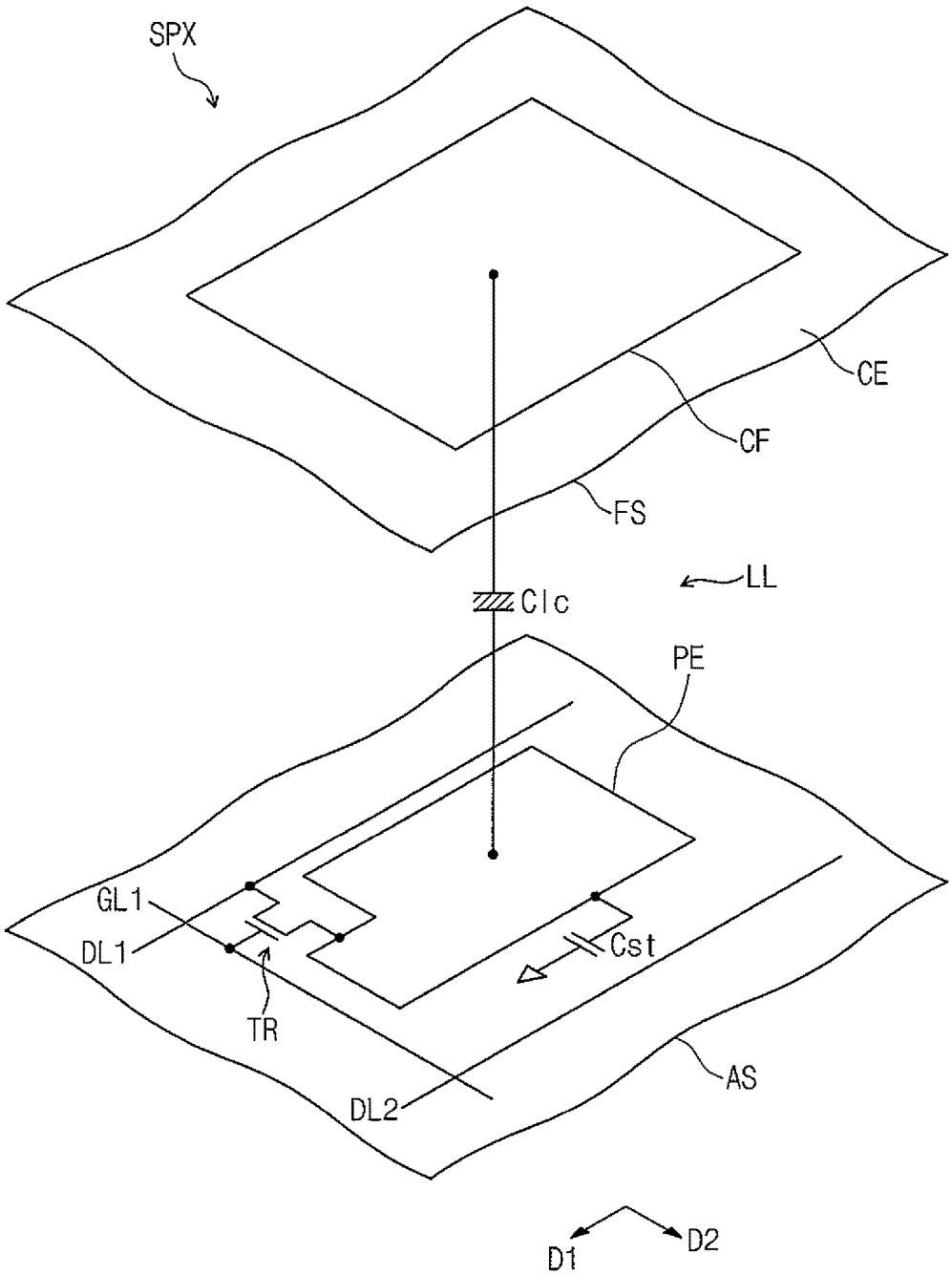
FIG. 2 is a schematic perspective view of a sub pixel of FIG. 1.

FIG. 2 is a schematic perspective view of the sub pixel SPX of FIG. 1.

Referring to FIG. 2, the display panel 200 includes an array substrate AS, an opposite substrate FS, and a liquid crystal layer LL disposed between the array substrate AS and the opposite substrate FS.

The sub pixel SPX includes a transistor TR connected to a first gate line GL1 and a first data line DL1, a liquid crystal capacitor Clc connected to the transistor TR, and a storage capacitor Cst parallely connected to the liquid crystal capacitor Clc. The storage capacitor Cst may be omitted.

The transistor TR may be disposed on the array substrate AS. The transistor TR includes a gate electrode connected to the first gate line GL1, a source electrode connected to the first data line DL1, and a drain electrode connected to the liquid crystal capacitor Clc and the storage capacitor Cst.

The liquid crystal capacitor Clc includes a pixel electrode PE disposed on the array substrate As, a common electrode CE disposed on the opposite substrate FS, and the liquid crystal layer LL disposed between the pixel electrode PE and the common electrode CE. The liquid crystal layer LL may serve as a dielectric. The pixel electrode PE is connected to the drain electrode of the transistor TR.

The common electrode CE may be disposed on an entire area of the opposite substrate FS. However, embodiments of the present inventive concept are not limited thereto. For example, the common electrode CE may be disposed on the array substrate AS. At least one of the pixel electrode PE and the common electrode CE may include a slit.

The storage capacitor Cst may include the pixel electrode PE, a storage electrode that is branched from a storage line, and an insulation layer disposed between the pixel electrode PE and the storage electrode. The storage line is disposed on the array substrate AS. Also, the storage line may be concurrently (e.g., simultaneously) formed on the same layer as the first gate line GL1. The storage electrode may partially overlap the pixel electrode PE.

The sub pixel SPX may further include a color filter CF for representing one of the primary colors. According to an embodiment of the present inventive concept, the color filter CF may be disposed on the opposite substrate FS. According to another embodiment of the present inventive concept, the color filter CF may be disposed on the array substrate AS.

The transistor TR is turned on in response to the gate signal provided through the first gate line GL1. The data voltage received through the first data line DL1 is provided to the pixel electrode PE of the liquid crystal capacitor Clc through the transistor TR that is turned on. A common voltage is applied to the common electrode CE.

An electric field is generated between the pixel electrode PE and the common electrode CE by a difference in voltage level between the data voltage and the common voltage. Liquid crystal molecules of the liquid crystal layer LL operate by the electric field generated between the pixel electrode PE and the common electrode CE. Light transmittance may be adjusted by the liquid crystal molecules that operate by the generated electric field to display an image.

A storage voltage having a uniform voltage level may be applied to the storage line. However, embodiments of the present inventive concept are not limited thereto. For example, the common voltage may be applied to the storage line. The storage capacitor Cst may maintain a voltage that is charged in the liquid crystal capacitor Clc.

Figure 3:
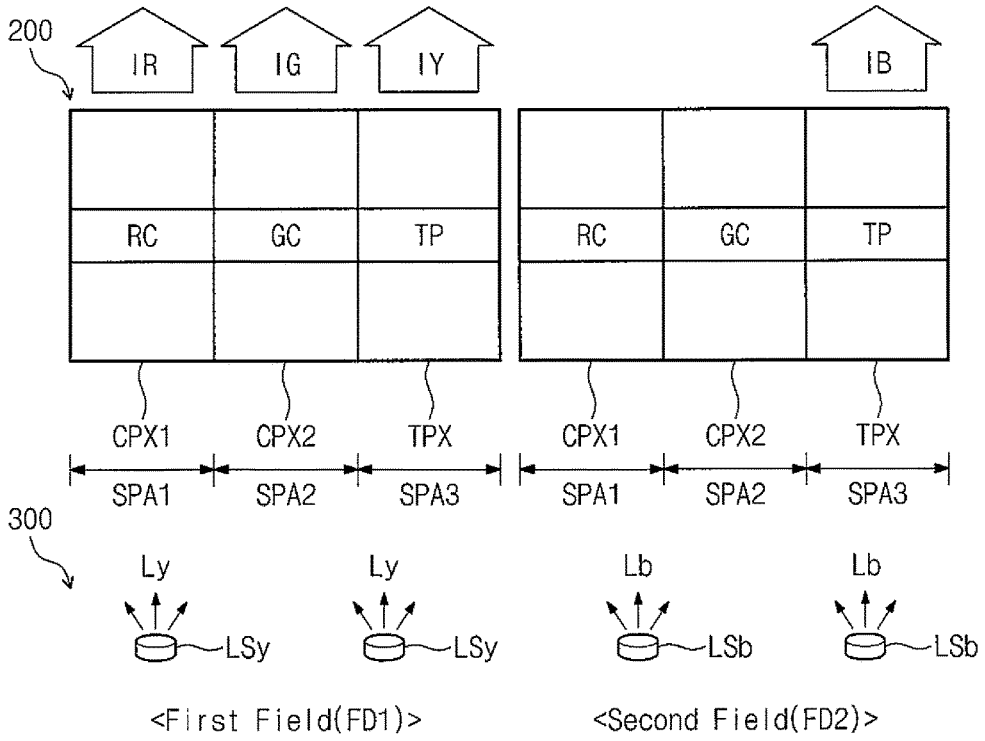
FIG. 3 is a view illustrating a principle for realizing a full color display by space-time division switching.

FIG. 3 is a view illustrating a principle for realizing a full color display by space-time division switching.

FIG. 3 illustrates an operation of the display panel 200 in first and second fields FD1 and FD2. One frame FR is time-divided into the first and second fields FD1 and FD2.

According to an embodiment of the present inventive concept, the display panel 200 includes a first color sub pixel CPX1, a second color sub pixel CPX2, and a transmissive sub pixel TPX. Each of the first and second color sub pixels CPX1 and CPX2 may have a structure similar to the sub pixel SPX of FIG. 2. Also, the first transmissive sub pixel TPX may have a structure in which the color filter CF is removed from the sub pixel SPX of FIG. 2.

Areas corresponding to the sub pixels CPX1, CPX2, and TPX may be defined as first to third sub pixel areas SPA1 to SPA3, respectively. The first and second color sub pixels CPX1 and CPX2 may include first and second color filters RC and GC provided on the first and second sub pixel areas SPA1 and SPA2, respectively. Also, the transmissive sub pixel TPX may not include the color filter, but include a transmissive part (e.g., a transmissive layer) TP provided on the third sub pixel area SPA3 instead of the color filter.

In an embodiment of the present inventive concept, the first color filter RC may be a red color filter that filters the received light to transmit only red light therethrough. The second color filter GC may be a green color filter that filters the received light to transmit only green light therethrough. The transmissive part TP may not transmit light having a specific color therethrough. The transmissive part TP may have a preset or predetermined transmittance within a visible light region.

The backlight unit 300 includes a first light source LSy and a second light source LSb. For example, each of the first and second light sources LSy and LSb may include a light emitting diode. The first light source LSy emits first light Ly having a first color, and the second light source LSb emits second light Lb having a second color different from the first color.

According to an embodiment of the present inventive concept, the first and second colors may complement each other. For example, a mixed color of the first and second colors may be a white color.

According to an embodiment of the present inventive concept, the first color may be a yellow color, and the second color may be a blue color. That is, the first and second light Ly and Lb may be yellow light and blue light, respectively. However, embodiments of the present inventive concept are not limited thereto. For example, each of the first and second colors may be one of the red, green, cyan, and magenta colors.

In the first field FD1, the first light source LSy outputs the first light Ly in response to the backlight control signal BCS (see FIG. 1). Thereafter, in the second field FD2, the second light source LSb outputs the second light Lb in response to the backlight control signal BCS.

Red light of the first layer Ly generated by the first light source LSy passes through the first color filter RC and then is displayed as a red image IR during the first field FD1, and green light of the first light Ly passes through the second color filter GC and then is displayed as a green image IG. Also, the first light Ly passes through the transmissive part TP and then is displayed as a yellow image IY.

Thereafter, the second light Lb generated by the second light source LSb passes through the transmissive part TP and then is displayed as a blue image IB. Because the second light Lb does not pass through the first and second color filters RC and GC, an image may not be displayed through the first and second pixel areas PA1 and PA2.

As described above, the transmissive sub pixel TPX displays the yellow image IY during the first field FD1 and displays the blue image IB during the second field FD2. Because the transmissive part TP does not include the color filter, the first and second light Ly and Lb may be transmitted mostly without light loss due to the color filter. Thus, light efficiency of the display panel 200 may be improved (e.g., increased).

Figure 4:
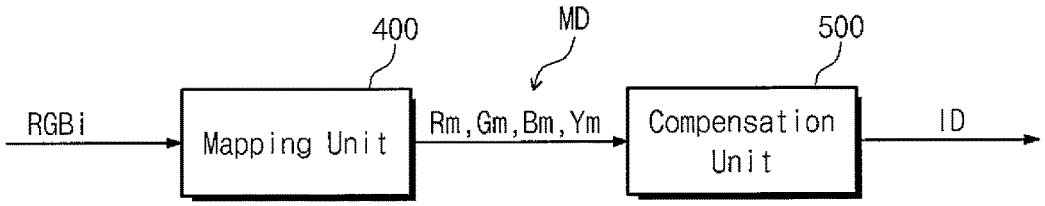
FIG. 4 is a schematic block diagram of a mapping unit and compensation unit according to an embodiment of the present inventive concept.

FIG. 4 is a schematic block diagram of a mapping unit and compensation unit according to an embodiment of the present inventive concept.

Hereinafter, a mapping unit (e.g., a mapper) 400 and a compensation unit (e.g., a compensator) 500 will be described with reference to FIG. 4. In an embodiment of the present inventive concept, the mapping part (e.g., mapper) 400 and the compensation unit 500 may constitute the controller (see reference numeral 100 of FIG. 1).

The mapping unit 400 receives the input image signal RGBi to convert the input image signal RGBi into mapping data MD.

In an embodiment of the present inventive concept, the mapping unit 400 may generate the mapping data MD including information with respect to four colors on the basis of the input image signal RGBi. In an embodiment of the present inventive concept, the mapping unit 400 may map RGB gamut of the input image signal RGBi to RGBY gamut through a gamut mapping algorism (GMA) to generate the mapping data.

For example, the input image signal RGBi may include red, green, and blue signals, which respectively have red, green, and blue information. For example, the mapping data MD may include red, green, blue, and yellow mapping data Rm, Gm, Bm, and Ym, which respectively have red, green, blue, and yellow information.

In an embodiment of the present inventive concept, the mapping unit 400 may extract the yellow information from the red, green, and blue signals to generate the yellow mapping data Ym on the basis of the extracted yellow information. In an embodiment of the present inventive concept, the mapping unit 400 may determine a minimum gradation value of the red signal and a minimum gradation value of the green signal as a gradation value of the yellow mapping data YM.

Also, the mapping unit 400 may convert the red, green, and blue signals into the red, green, and blue mapping data Rm, Gm, and Bm on the basis of the yellow mapping data Ym. In an embodiment of the present inventive concept, the gradation values of the red, green, and blue mapping data Rm, Gm, and Bm may be values that are obtained by subtracting the graduation value of the yellow mapping data Ym from the gradation values of the red, green, and blue signals.

The compensation unit 500 receives the mapping data MD to convert the mapping data MD into the output image data ID. More particularly, the compensation unit 500 performs accurate color capture (ACC) compensation and dynamic capacitance capture (DCC) compensation on the mapping data MD to convert the mapping data MD into the output image data ID.

Figure 5:
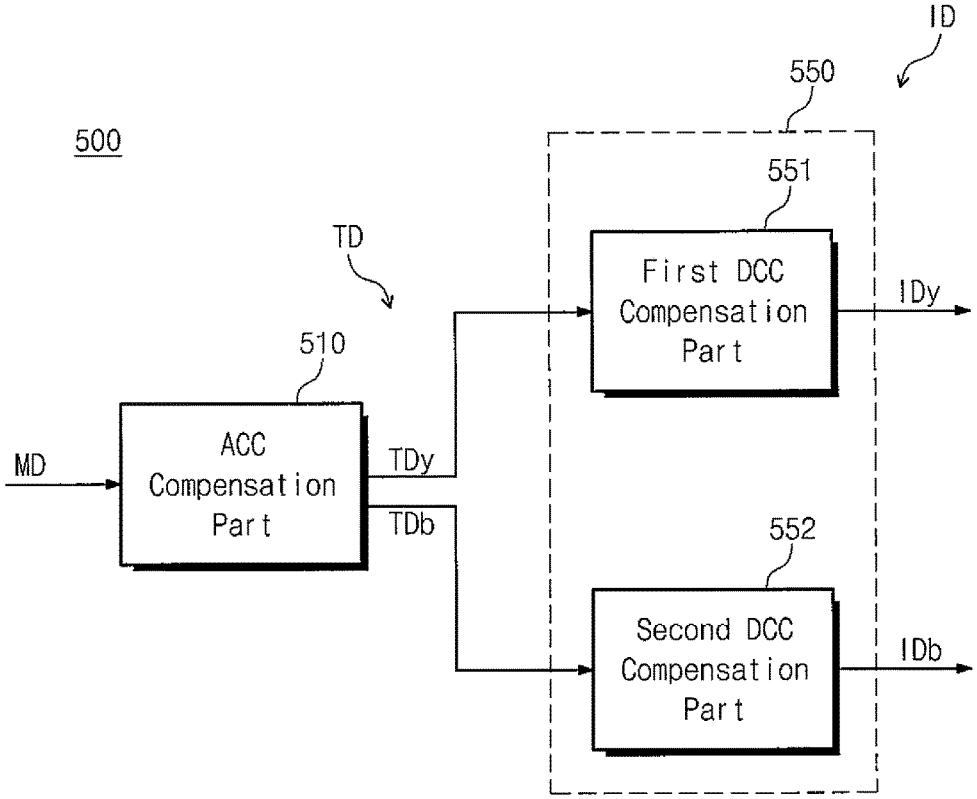
FIG. 5 is a block diagram of the compensation unit of FIG. 4.

FIG. 5 is a block diagram of the compensation unit of FIG. 4.

Referring to FIG. 5, the compensation unit 500 includes an ACC compensation part (e.g., an ACC compensator) 510 for performing the ACC compensation and a DCC compensation part (e.g., a DCC compensator) 550 for performing the DCC compensation.

The ACC compensation part 510 receives the mapping data MD to convert the mapping data MD into compensation data TD by using the ACC compensation. In an embodiment of the present inventive concept, the compensation data TD includes first compensation data TDy and second compensation data TDb.

The ACC compensation part 510 may prevent or substantially prevent color characteristics from being shifted according to a variation in gradation to maintain a color balance in each gradation. The phenomenon in which the color characteristics are shifted may be caused by gamma characteristics of the display apparatus (see reference numeral 1000 of FIG. 1). More particularly, green gamma characteristics, red gamma characteristics, yellow gamma characteristics, and blue gamma characteristics of the display apparatus 1000 are different from each other according to a driving method and structure of the display apparatus 1000. Thus, the display apparatus 1000 may display red, green, yellow, and blue images that have luminances different from each other, despite the red, green, yellow, and blue data having the same gradation value.

To compensate the difference in luminance, the ACC compensation part 510 may set a reference gamma characteristic (e.g., about 2.2 gamma) to determine a deviation between the reference gamma characteristic and a gradation of each of the red, green, and blue gamma characteristics as a gamma compensation value.

The DCC compensation part 550 receives the compensation data TD to convert the compensation data TD into the output image data ID by using the DCC compensation.

The DCC compensation part 550 may compensate the current gradation value on the basis of the preset DCC compensation data according to a difference between the current gradation value and the previous gradation value to improve (e.g., increase) a response speed of the liquid crystal molecules. That is, the current gradation value increases above a target gradation value. In an embodiment of the present inventive concept, the DCC compensation part 550 may compensate the response speed of the compensation data TD that is compensated by the ACC compensation part 510.

In an embodiment of the present inventive concept, the DCC compensation part 550 includes a first DCC compensation part (e.g., a first DCC compensator) 551 and a second DCC compensation part (e.g., a second DCC compensator) 555. The first DCC compensation part 551 receives the first compensation data TDy to DCC compensate the first compensation data TDy, thereby preventing or substantially preventing leakage light from occurring in the first field (see reference symbol FD1 of FIG. 3). Then, the first DCC compensation part 551 converts the first compensation data TDy into first output image data IDy of the output image data ID. The second DCC compensation part 555 receives the second compensation data TDb to DCC compensate the second compensation data TDb, thereby preventing or substantially preventing leakage of light from occurring in the second field (see reference symbol FD2 of FIG. 3). Then, the second DCC compensation part 555 converts the second compensation data TDb into second output image data IDb of the output image data ID.

Figure 6:
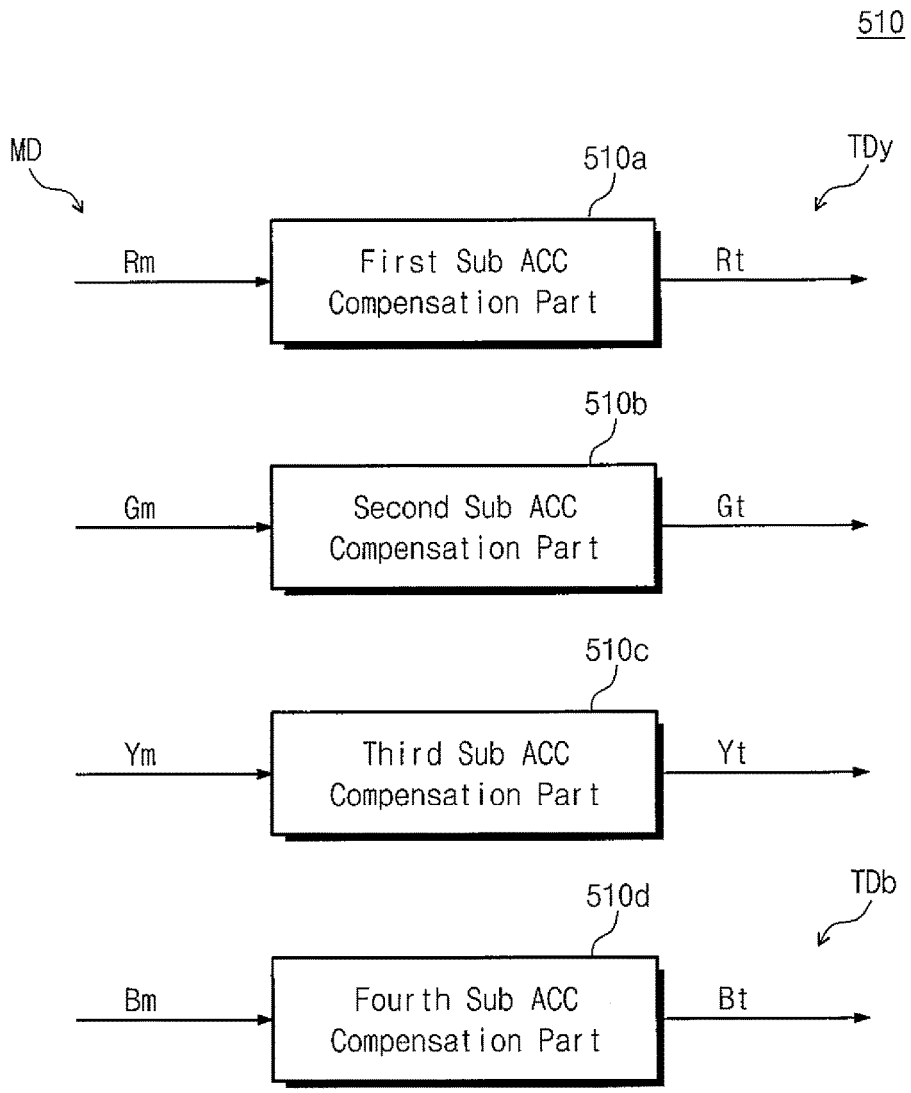
FIG. 6 is a block diagram of an accurate color capture (ACC) compensation unit of FIG. 5.

FIG. 6 is a block diagram of the ACC compensation part of FIG. 5.

Referring to FIG. 6, an operation of the ACC compensation part 510 will be further described.

In an embodiment of the present inventive concept, the ACC compensation part 510 includes first to fourth sub ACC compensation parts (e.g., first to fourth sub ACC compensators) 510*a* to 510*d*.

The first sub ACC compensation part (e.g., the first sub ACC compensator) 510*a* ACC compensates the red mapping data Rm of the mapping data MD on the basis of the red gamma compensation value to convert the red mapping data Rm into red compensation data Rt of the first compensation data TDy. The red gamma compensation value may be determined based on the red gamma characteristics.

The second sub ACC compensation part (e.g., the first sub ACC compensator) 510*b* ACC compensates the green mapping data Gm of the mapping data MD (on the basis of the green gamma compensation value) to convert the green mapping data Gm into green compensation data Gt of the first compensation data TDy. The green gamma compensation value may be determined based on the green gamma characteristics.

The third sub ACC compensation part (e.g., the third sub ACC compensator) 510*c* ACC compensates the yellow mapping data Ym of the mapping data MD (on the basis of the yellow gamma compensation value) to convert the yellow mapping data Ym into yellow compensation data Yt of the first compensation data TDy. The yellow gamma compensation value may be determined based on the yellow gamma characteristics.

The fourth sub ACC compensation part (e.g., the fourth sub ACC compensator) 510*d* ACC compensates the blue mapping data Bm of the mapping data MD (on the basis of the blue gamma compensation value) to convert the blue mapping data Bm into blue compensation data Bt of the second compensation data TDb. The blue gamma compensation value may be determined based on the blue gamma characteristics.

Figure 7:
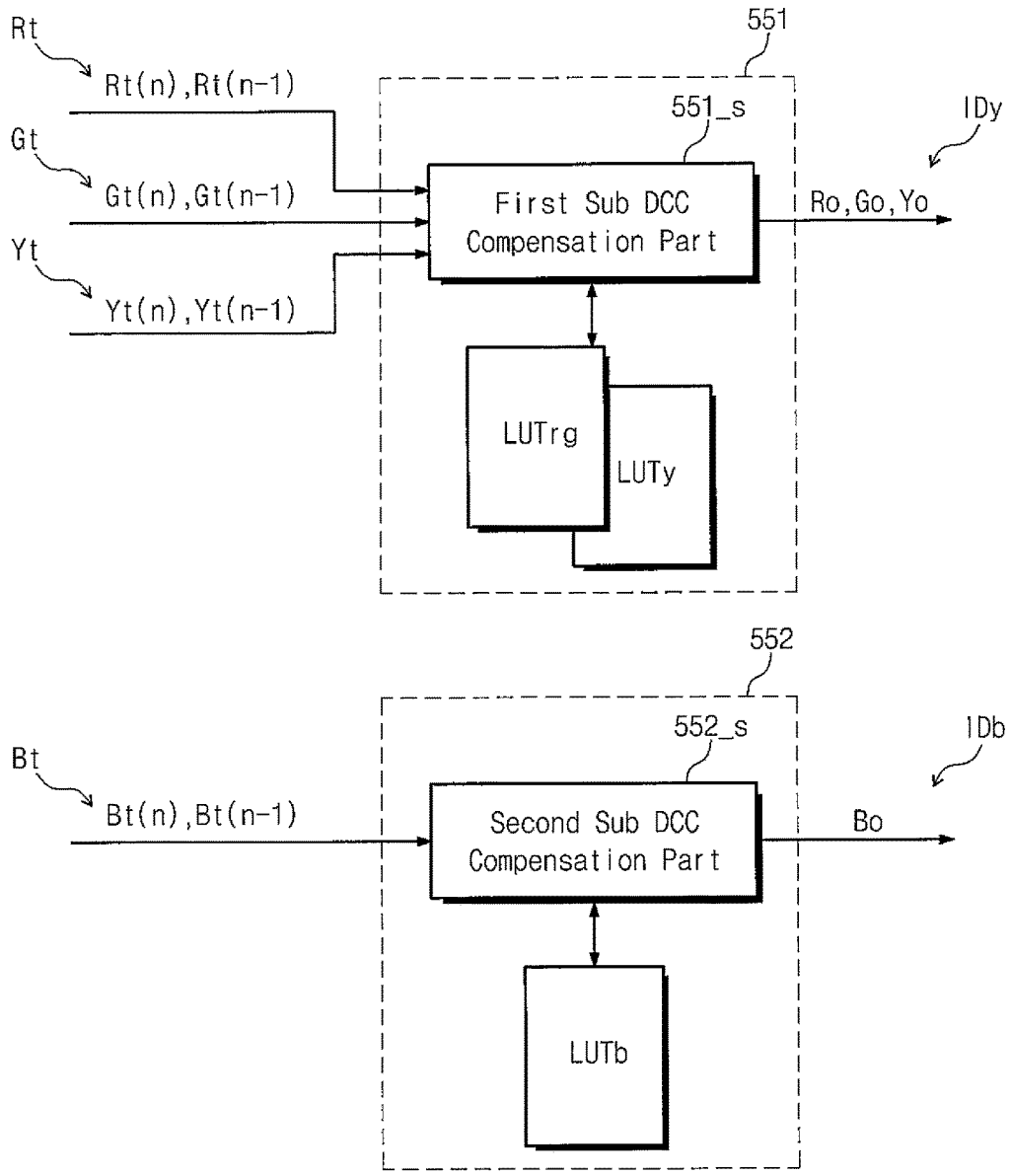
FIG. 7 is a block diagram of the dynamic capacitance capture (DCC) compensation unit of FIG. 5.

FIG. 7 is a block diagram of the DCC compensation part of FIG. 5.

Referring to FIG. 7, the first DCC compensation part 551 may include a first sub DCC compensation part (e.g., a first sub DCC compensator) 551_*s* and a first lookup table LUTy.

The first sub DCC compensation part 551_*s* may compensate an n-th yellow compensation data Yt(n) and an (n−1)-th yellow compensation data Yt(n−1) of the yellow compensation data Yt (on the basis of the first DCC compensation data) to generate yellow output image data Yo of the first output image data IDy. The n-th and (n−1)-th yellow compensation data Yt(n) and Yt(n−1) may be the yellow compensation data Yt in n-th and (n−1)-th frames, respectively. The first DCC compensation data may be stored in the first lookup table LUTy. The first DCC compensation data according to a gradation value of the n-th yellow compensation data Yt(n) and a gradation value of the (n−1)-th yellow compensation data Yt(n−1) are stored in the first lookup table LUTy. The first sub DCC compensation part 551_*s* may select the first DCC compensation data corresponding to the gradation values of the n-th and (n−1)-th yellow compensation data Yt(n) and Yt(n−1) to generate the yellow output image data Yo on the basis of the selected first DCC compensation data.

The first DCC compensation data is generated based on first leakage light.

Referring again to FIG. 3, the first leakage light may be the first light Ly that leaks by a slow response speed of the liquid crystal molecules of the transmissive sub pixel TPX in the first field FD1. For example, in a case where a blue color is displayed in the current frame, the liquid crystal molecules do not sufficiently operate for the first field FD1 due to the slow response speed of the liquid crystal molecules in spite of the transmittance of the transmissive sub pixel TPX being zero. If the transmittance of the transmissive sub pixel TPX is not zero, the yellow color may be mixed by the first leakage light of the first light Ly, which leaks from the transmissive sub pixel TPX. The intensity of the first leakage light may be proportional to a difference between target transmittance of the transmissive sub pixel TPX and actual transmittance of the transmissive sub pixel TPX in the first field FD1.

The second DCC compensation part 552 includes a second sub DCC compensation part (e.g., a second sub DCC compensator) 552_*s* and a second lookup table LUTb.

The second sub DCC compensation part 552_*s* compensates the blue compensation data Bt (on the basis of the second DCC compensation data) to convert the blue compensation data Bt into blue output image data Bo of the second output image data IDb. The second DCC compensation data may be stored in the second lookup table LUTb.

The second sub DCC compensation part 552_*s* may compensate an n-th blue compensation data Bt(n) and an (n−1)-th blue compensation data Bt(n−1) of the blue compensation data Bt (on the basis of the second DCC compensation data) to generate the blue output image data Bo. The n-th and (n−1)-th blue compensation data Bt(n) and Bt(n−1) may be the blue compensation data Bt in n-th and (n−1)-th frames, respectively. The second DCC compensation data may be stored in the second lookup table LUTb. The second DCC compensation data according to a gradation value of the n-th blue compensation data Yt(n) and a gradation value of the (n−1)-th blue compensation data Bt(n−1) are stored in the second lookup table LUTb. The second sub DCC compensation part 552_*s* may select the second DCC compensation data corresponding to the gradation values of the n-th and (n−1)-th blue compensation data Bt(n) and Bt(n−1) to generate the blue output image data Bo on the basis of the selected second DCC compensation data.

More particularly, the second DCC compensation data is generated based on second leakage light.

Referring again to FIG. 3, the second leakage light may be the second light Lb that leaks by the slow response speed of the liquid crystal molecules of the transmissive sub pixel TPX in the second field FD2. For example, in a case where a yellow color is displayed in the current frame, the liquid crystal molecules do not sufficiently operate for the second field FD2 due to the slow response speed of the liquid crystal molecules in spite of the transmittance of the transmissive sub pixel TPX being zero. If the transmittance of the transmissive sub pixel TPX is not zero, the blue color may be mixed by the second leakage light of the second light Lb, which leaks from the transmissive sub pixel TPX. The intensity of the second leakage light may be proportional to a difference between the target transmittance of the transmissive sub pixel TPX and the actual transmittance of the transmissive sub pixel TPX in the second field FD2.

In an embodiment of the present inventive concept, because a first luminance coefficient of the first light Ly is different from a second luminance of the second light Lb, degrees of the first and second leakage light, which are recognized by the person may be different from each other. Thus, the first sub DCC compensation data and the second DCC compensation data may be determined based on the first and second luminance coefficients in consideration of degrees of the colors, which are recognized by the person.

In an embodiment of the present inventive concept, because the first and second light Ly and Lb have respectively the yellow and blue colors, the first luminance coefficient may be greater than the second luminance coefficient, and the value of the first DCC compensation data may be less than that of the second DCC compensation data. Thus, the liquid crystals of the transmissive sub pixel TPX may more quickly operate to perform the DCC compensation in the second field FD2 than the first field FD1.

Also, the first sub DCC compensation part 551_*s* may compensate an n-th red compensation data Rt(n) and an (n−1)-th red compensation data Rt(n−1) of the red compensation data Rt (on the basis of the third DCC compensation data) to generate red output image data Ro of the first output image data IDy. The n-th and (n−1)-th red compensation data Rt(n) and Rt(n−1) may be the red compensation data Rt in n-th and (n−1)-th frames, respectively.

Also, the first sub DCC compensation part 551_*s* may compensate an n-th green compensation data Gt(n) and an (n−1)-th green compensation data Gt(n−1) of the green compensation data Gt (on the basis of the third DCC compensation data) to generate green output image data Go of the first output image data IDy. The n-th and (n−1)-th green compensation data Gt(n) and Gt(n−1) may be the green compensation data Gt in n-th and (n−1)-th frames, respectively. The third DCC compensation data may be stored in the third lookup table LUTrg. The third DCC compensation data according to a gradation value of the n-th red compensation data Yt(n) (or a gradation value of the n-th green compensation data Gt(n)) and a gradation value of the (n−1)-th red compensation data Rt(n−1) (or a gradation value of the (n−1)-th green compensation data Gt(n−1)) are stored in the third lookup table LUTrg. The first sub DCC compensation part 551_*s* may select the third DCC compensation data corresponding to the gradation values of the n-th and (n−1)-th red compensation data Rt(n) and Rt(n−1) to generate the red and green output image data Ro and Go on the basis of the selected third DCC compensation data.

In an embodiment of the present inventive concept, the red and green compensation data Rt and Gt may be DCC compensated by separate sub DCC compensation parts, respectively. The red and green compensation data Rt and Gt may be DCC compensated by the sub DCC compensation parts different from each other on the basis of the DCC compensation data different from each other, respectively.

Referring again to FIG. 3, the red, green, and yellow output image data Ro, Go, and Yo may be converted into data voltages and then provided to the first and second color sub pixels CPX1 and CPX2 and the transmissive sub pixel TPX in the first field FD1. Thus, in the first field FD1, the sub pixels CPX1, CPX2, and TPX modulate the first light Ly on the basis of the red, green, and yellow output image data Ro, Go, and Yo to display the red, green, and yellow images RI, GI, and YI. Also, the blue output image data Bo is converted into a data voltage and provided to the transmissive sub pixel TPX in the second field FD2. Thus, in the second field FD2, the transmissive tub pixel TPX may modulate the second light Lb on the basis of the blue output image data Bo to display the blue image BI.

Figure 8A:
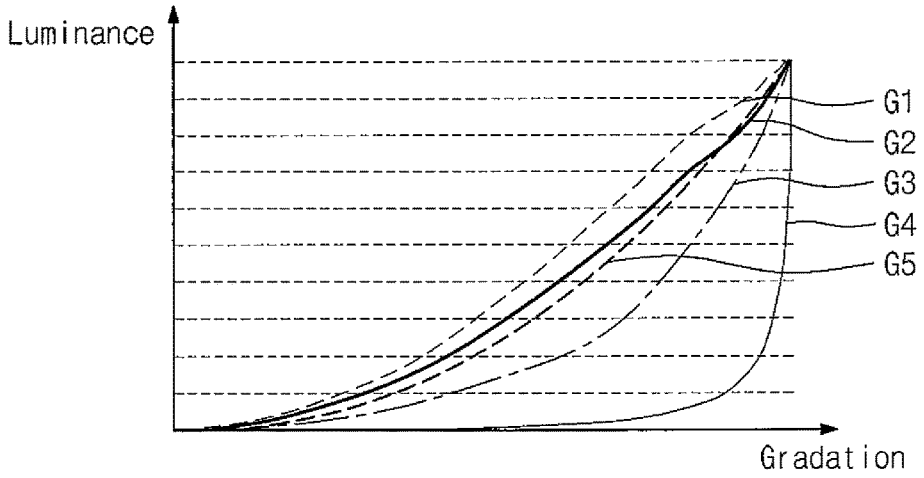
FIG. 8A is a graph illustrating a gamma curve of the display apparatus to which DCC compensation is not applied according to an embodiment of the present inventive concept.
Figure 8B:
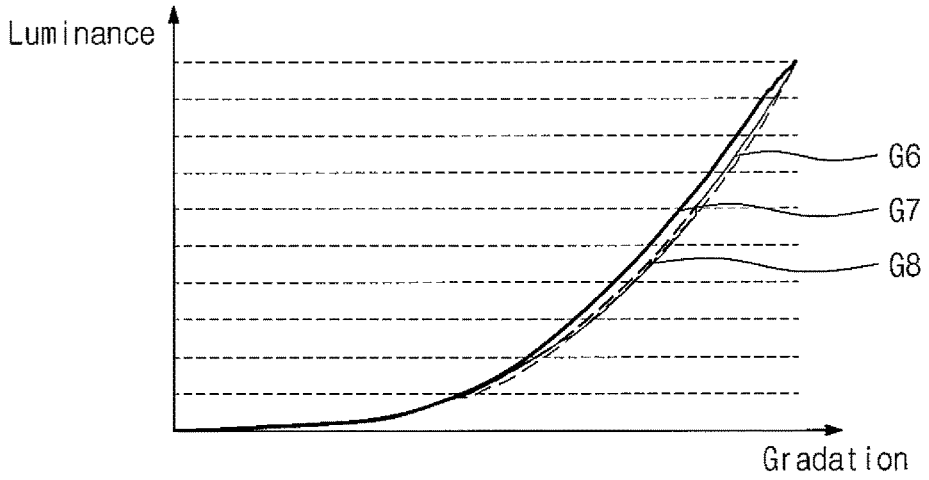
FIG. 8B is a graph illustrating a gamma curve of the display apparatus to which the DCC compensation is applied according to an embodiment of the present inventive concept.

FIG. 8A is a graph illustrating a gamma curve of the display apparatus to which DCC compensation is not applied according to an embodiment of the present inventive concept. FIG. 8B is a graph illustrating a gamma curve of the display apparatus to which the DCC compensation is applied according to an embodiment of the present inventive concept.

Hereinafter, the gamma curves will be described with reference to FIGS. 8A and 8B.

Referring to FIG. 8A, the display apparatus (hereinafter, referred to as a reference display apparatus) to which the DCC compensation, according to an embodiment of the present inventive concept, is not applied, is driven by the output image data in which the red, green, yellow, and the blue mapping image data are compensated on the basis of the same DCC compensation data. In this case, values of red, green, yellow, and blue gamma curves G1, G2, G3, and G4 may be largely different from a value of a 2.2 gamma curve G5. Particularly, the blue gamma curve G4 has a very low value in low and middle gradation regions. In this case, when the blue mapping data having a gradation value within the low and middle gradation regions is inputted, a color displayed on the reference display apparatus may be significantly distorted, and color reproducibility of the reference display apparatus may be deteriorated.

On the other hand, the display apparatus (see reference numeral 1000 of FIG. 1), according to an embodiment of the present inventive concept, generates the yellow and blue output image data (see reference symbol Ye and Bo of FIG. 7) by using the first and second DCC compensation data, which accounts for the first and second leakage light, and the first and second luminance coefficients. The display apparatus uses the yellow and blue output image data Yo and Bo to reduce the color mixing due to the first and second leakage light. Thus, red, green, and blue gamma curves G6, G7, and G8 of the display apparatus 1000 may approximately correspond to the 2.2 gamma curve G5 in all gradations. Thus, even though the blue output data Bo having the gradation value within the low and middle gradation regions is inputted, the distortion of the color displayed on the display apparatus 1000 may be prevented or substantially prevented to improve the color reproducibility of the display apparatus 1000.

Figure 9:
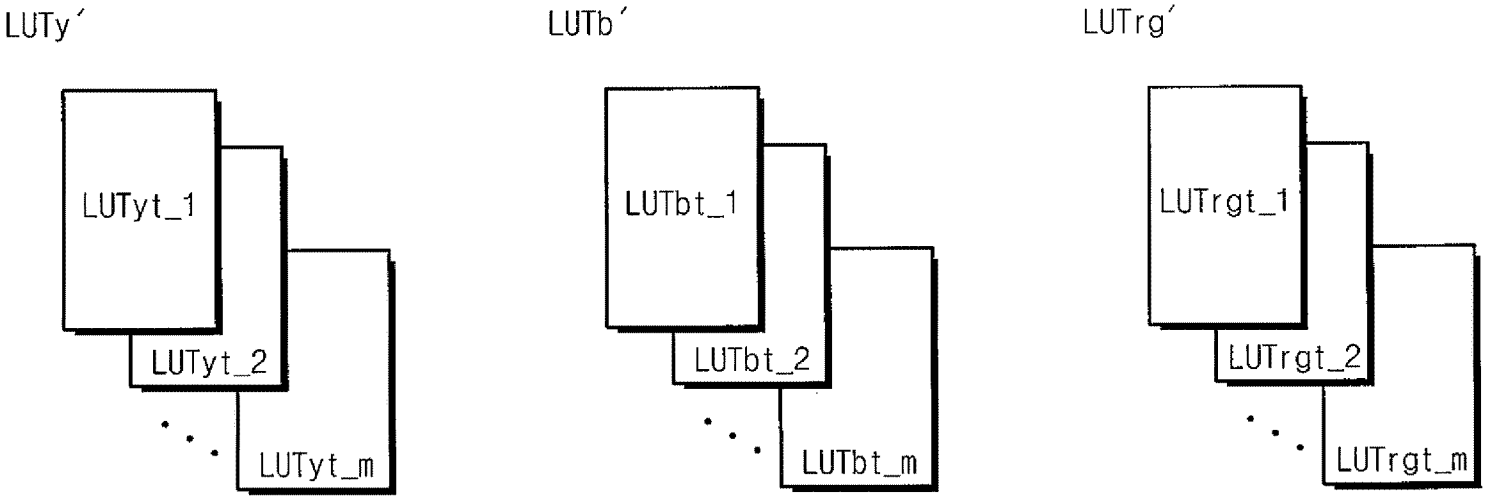
FIG. 9 is a view illustrating first to third lookup tables according to another embodiment of the present inventive concept.

FIG. 9 is a view illustrating first to third lookup tables according to another embodiment of the present inventive concept.

Referring to FIG. 9, a first lookup table LUTy' according to another embodiment of the present inventive concept includes m first temperature lookup tables LUTyt_1 to LUTyt_m. The first temperature lookup tables LUTyt_1 to LUTyt_m store m first temperature DCC compensation data that are determined according to m temperatures, respectively.

Also, a second lookup table LUTb' according to another embodiment of the present inventive concept includes m second temperature lookup tables LUTbt_1 to LUTbt_m. The second temperature lookup tables LUTbt_1 to LUTbt_m store m second temperature DCC compensation data that are determined according to m temperatures, respectively.

Also, a third lookup table LUrgb' according to another embodiment of the present inventive concept includes m third temperature lookup tables LUTrgt_1 to LUTrgt_m. The third temperature lookup tables LUTrgt_1 to LUTrgt_m store m third temperature DCC compensation data that are determined according to m temperatures, respectively.

The first to third temperature DCC compensation data may be determined according to a temperature of the display apparatus (see reference numeral 1000 of FIG. 1) or an external temperature (hereinafter, referred to as a driving temperature). The display apparatus 1000 may have color reproducibility that varies according to the driving temperature. This is done because driving characteristics (e.g., viscosity of the liquid crystal) of the liquid crystal of the display apparatus 1000 vary according to the driving temperature.

The first and second sub DCC compensation parts (see reference numerals 511_*s* and 512_*s* of FIG. 7) select temperature DCC compensation data corresponding to the current driving temperature of the first to third temperature DCC compensation data to perform DCC compensation on the basis of the selected temperature DCC compensation data.

Thus, an occurrence of a deviation in a color coordinate of an image displayed on the display apparatus 1000 according to the driving temperature may be prevented or substantially prevented, and the color reproducibility of the display apparatus may be maintained regardless of the driving temperature.

Figure 10:
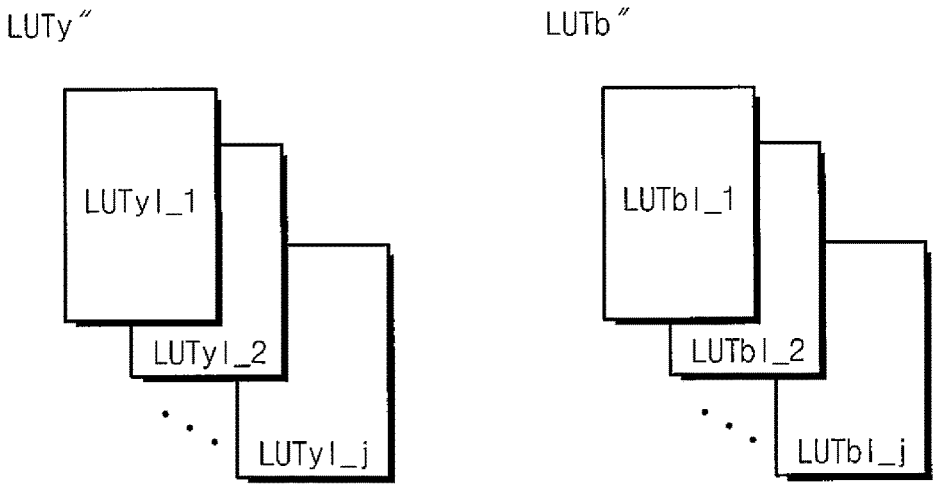
FIG. 10 is a view illustrating first to third lookup tables according to another embodiment of the present inventive concept.

FIG. 10 is a view illustrating first to third lookup tables according to another embodiment of the present inventive concept.

Referring to FIG. 10, a first lookup table LUT'" according to another embodiment of the present inventive concept includes j first light intensity lookup tables LUTyt_1 to LUTyt_j. The first light intensity lookup tables LUTyt_1 to LUTyt_j store j first light intensity DCC compensation data that are determined according to intensities of j first light Ly, respectively.

Also, a second lookup table LUTb" according to another embodiment of the present inventive concept includes j second light intensity lookup tables LUTbl_1 to LUTbl_j. The second light intensity lookup tables LUTbl_1 to LUTbl_j store j second light intensity DCC compensation data that are determined according to intensities of j second light Lb, respectively.

The first and second light intensity DCC compensation data may be determined according to intensities of the first and second light Ly and Lb. The first and second leakage light may vary in intensity according to the intensities of the first and second light Ly and Lb.

The first and second sub DCC compensation parts (see reference numerals 511_*s* and 512_*s* of FIG. 7) select light intensity DCC compensation data corresponding to the current (present) intensities of the first and second light Ly and Lb of the first and second light intensity DCC compensation data to perform DCC compensation on the basis of the selected light intensity DCC compensation data.

Thus, an occurrence of a deviation in a color coordinate of an image displayed on the display apparatus 1000 according to the intensities of the first and second light Ly and Lb may be prevented or substantially prevented, and the color reproducibility of the display apparatus may be maintained regardless of the light intensity.

Although the embodiment in which the display apparatus is synchronized with the two fields and time-divided to be driven is described above, embodiments of the present inventive concept are not limited thereto. The display apparatus, according to another embodiment of the present inventive concept, may be synchronized with one field and time-divided to be driven, and the color output image data respectively provided to the transmissive sub pixels during i fields may be generated based on the i DCC compensation data that are determined to correspond to colors of i light sources.

As described above, the first and second color mapping data respectively provided to the transmissive sub pixels during the first and second fields may be DCC compensated based on the first and second DCC compensation data, respectively. Because the first and second DCC compensation data are determined based on the first and second leakage light of the first and second light, the color mixing due to the first and second leakage light may be solved to improve the color reproducibility of the display apparatus.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

It will be understood that when a layer (or film), a region, or a plate is referred to as being 'under' another layer, region, or plate, it can be directly under the other layer (or film), region, or plate, or intervening layers, regions, or plates may also be present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display apparatus and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display apparatus may be formed on one integrated circuit (IC) chip or on separate IC chips. Further, the various components of the display apparatus may be implemented on a flexible printed circuit film, a tape carrier package (TCP), a printed circuit board (PCB), or formed on a same substrate. Further, the various components of the display apparatus may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

It will be apparent to those skilled in the art that various modifications and variations can be made in the present inventive concept. Thus, it is intended that the present disclosure covers the modifications and variations of the present inventive concept provided they come within the scope of the appended claims and their equivalents.

What is claimed is:

1. A display apparatus comprising:

a backlight configured to output a first light having a first color during a first field of a frame and to output a second light having a second color during a second field of the frame;

a mapper configured to receive an input image signal and configured to map the input image signal into a first mapping data corresponding to the first light and a second mapping data corresponding to the second light, the input image signal having a red, green, and blue (RGB) gamut and a combination of the first and second mapping data having a red, green, blue, and yellow (RGBY) gamut;

a compensator configured to receive the first mapping data and the second mapping data and to compensate a first color mapping data of the first mapping data on a basis of a first DCC compensation data so as to generate a first color output image data, and to compensate a second color mapping data of the second mapping data on a basis of second DCC compensation data so as to generate a second color output image data; and a liquid crystal panel comprising a transmissive sub pixel configured to modulate the first light on a basis of the first color output image data during the first field to display a first image having the first color, and to modulate the second light on a basis of the second color output image data during the second field to display a second image having the second color.

2. The display apparatus of claim 1, wherein the first DCC compensation data is determined based on first leakage light of the first light, the first leakage light being light leaking from the transmissive sub pixel, and wherein the second DCC compensation data is determined based on second leakage light of the second light, the second leakage light being light leaking from the transmissive sub pixel.

3. The display apparatus of claim 2, wherein the first DCC compensation data is determined based on a first luminance coefficient of the first color, and wherein the second DCC compensation data is determined based on a second luminance coefficient of the second color.

4. The display apparatus of claim 3, wherein the first luminance coefficient is greater than the second luminance coefficient, and wherein the first DCC compensation data has a value less than that of the second DCC compensation data.

5. The display apparatus of claim 1, wherein the compensator comprises a first DCC compensator and a second DCC compensator, wherein the first DCC compensator comprises:

a first lookup table configured to store the first DCC compensation data; and a first sub DCC compensator configured to receive the first color mapping data and to compensate the first color mapping data with reference to the first DCC compensation data, from the first lookup table, to generate the first color output image data, and wherein the second DCC compensator comprises:

a second lookup table configured to store the second DCC compensation data; and a second sub DCC compensator configured to receive the second color mapping data and to compensate the second color mapping data with reference to the second DCC compensation data, from the second lookup table, to generate the second color output image data.

6. The display apparatus of claim 1, wherein the liquid crystal panel comprises a first color sub pixel comprising a first color filter and a second color sub pixel comprising a second color filter, and wherein the first color filter is configured to transmit a third color therethrough, the second color filter is configured to transmit a fourth color therethrough, and the first color is a mixed color of the third and fourth colors.

7. The display apparatus of claim 6, wherein the first color is a yellow color, and the second color is a blue color.

8. The display apparatus of claim 6, wherein the compensator is further configured to compensate third and fourth color mapping data of the first mapping data on a basis of third DCC compensation data to generate third and fourth color output image data.

9. The display apparatus of claim 8, wherein the first color sub pixel is configured to modulate the first light on a basis of the third color output image data during the first field to display a third image having the third color, and wherein the second color sub pixel is configured to modulate the first light on a basis of the fourth color output image data during the first field to display a fourth image having the fourth color.

10. The display apparatus of claim 1, wherein the mapper further comprises an ACC compensator configured to ACC compensate the first and second color mapping data.

11. The display apparatus of claim 10, wherein the ACC compensator comprises:

a first sub ACC compensator configured to ACC compensate the first color mapping data; and a second sub ACC compensator configured to ACC compensate the second color mapping data.

12. The display apparatus of claim 1, wherein each of the first and second DCC compensation data comprises a plurality of temperature DCC compensation data determined according to a driving temperature, and wherein the compensator is further configured to select a temperature DCC compensation data corresponding to present driving temperature from among the plurality of temperature DCC compensation data.

13. The display apparatus of claim 1, wherein the first DCC compensation data comprises a plurality of first light intensity DCC compensation data determined according to an intensity of the first light, and wherein the compensator is further configured to generate the first color output image data on a basis of a first light intensity DCC compensation data corresponding to a present intensity of the first light from among the plurality of first light intensity DCC compensation data.

14. The display apparatus of claim 13, wherein the second DCC compensation data comprises a second light intensity DCC compensation data determined according to an intensity of the second light, and wherein the compensator is further configured to generate the second color output image data on a basis of a second light intensity DCC compensation data corresponding to the present intensity of the second light from among a plurality of second light intensity DCC compensation data.

15. The display apparatus of claim 1, wherein the transmissive sub pixel does not comprise a color filter.

16. A display apparatus comprising:

a backlight configured to output a first light having a first color during a first field of a frame and to output a second light having a second color during a second field of the frame;

a mapper configured to receive an input image signal and configured to map the input image signal into a first mapping data corresponding to the first light and a second mapping data corresponding to the second light;

a compensator configured to receive the first mapping data and the second mapping data and to compensate a first color mapping data of the first mapping data on a basis of a first DCC compensation data so as to generate a first color output image data, and to compensate a second color mapping data of the second mapping data on a basis of second DCC compensation data so as to generate a second color output image data; and a liquid crystal panel comprising a transmissive sub pixel configured to modulate the first light on a basis of the first color output image data during the first field to display a first image having the first color, and to modulate the second light on a basis of the second color output image data during the second field to display a second image having the second color, wherein the compensator comprises a first DCC compensator and a second DCC compensator, wherein the first DCC compensator comprises:

a first lookup table configured to store the first DCC compensation data; and a first sub DCC compensator configured to receive the first color mapping data and to compensate the first color mapping data with reference to the first DCC compensation data, from the first lookup table, to generate the first color output image data, and wherein the second DCC compensator comprises:

a second lookup table configured to store the second DCC compensation data; and a second sub DCC compensator configured to receive the second color mapping data and to compensate the second color mapping data with reference to the second DCC compensation data, from the second lookup table, to generate the second color output image data.

* * * * *